US007098418B1

(12) United States Patent
Yamada et al.

(10) Patent No.: US 7,098,418 B1
(45) Date of Patent: Aug. 29, 2006

(54) VACUUM CIRCUIT BREAKER, VACUUM CIRCUIT BREAKER CONTACT SLOW CLOSING METHOD, AND CONTACT EROSION MEASURING METHOD AND CONTACT GAP LENGTH SETTING METHOD USING THAT SLOW CLOSING METHOD

(75) Inventors: Hiroshi Yamada, Tokyo (JP); Kazuhiko Kagawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/217,495

(22) Filed: Sep. 2, 2005

(30) Foreign Application Priority Data

Apr. 28, 2005 (JP) ..... 2005-132259

(51) Int. Cl.
*H01H 33/666* (2006.01)

(52) U.S. Cl. ..... 218/120; 218/154; 324/424

(58) Field of Classification Search ..... 218/120, 218/140, 153, 154, 7, 10, 14, 78, 84; 200/400, 200/401; 361/71, 72, 115, 78; 324/424
See application file for complete search history.

(56) References Cited

U.S. PATENT DOCUMENTS 4,015,410 A * 4/1977 Smith ..... 56/364
5,422,450 A * 6/1995 Miyazawa et al. ..... 218/140
6,002,560 A * 12/1999 Nguyen et al. ..... 361/23
6,150,625 A * 11/2000 Marchand et al. ..... 218/118
6,373,015 B1 * 4/2002 Marchand et al. ..... 218/139

FOREIGN PATENT DOCUMENTS

JP 05-094742 4/1993
JP 11-086696 3/1999
JP 11-273511 10/1999

* cited by examiner

*Primary Examiner*—Lincoln Donovan
*Assistant Examiner*—M. Fishman

(74) *Attorney, Agent, or Firm*—Buchanan Ingersoll & Rooney PC

(57) ABSTRACT

An adjusting bolt is screwed into a nut attached to a dolly, and is disposed such that a central axis thereof is parallel to a closing and opening direction of a contact. A lever is attached to a shaft. An electrically-insulating rod is coupled to a first end of the lever, and a pin is mounted to a second end of the lever. The adjusting bolt is turned and lowered to lower the pin. The lever and the shaft are pivoted by the lowering of the pin, and the electrically-insulating rod is raised. Thus, a movable contact moves toward a fixed contact, moving the contact from an open state to a closed state.

6 Claims, 7 Drawing Sheets

VACUUM CIRCUIT BREAKER, VACUUM CIRCUIT BREAKER CONTACT SLOW CLOSING METHOD, AND CONTACT EROSION MEASURING METHOD AND CONTACT GAP LENGTH SETTING METHOD USING THAT SLOW CLOSING METHOD

BACKGROUND OF THE INVENTION

1. Field of the Invention

The present invention relates to a vacuum circuit breaker disposed so as to be fixed inside a switchgear, a vacuum circuit breaker contact slow closing method, and a contact erosion measuring method and contact gap length setting method using that slow closing method.

2. Description of the Related Art

In conventional gas-insulated cubicles, withstand voltages of contacts of vacuum interrupters disposed in sulfur hexafluoride ($SF_6$) gas have hitherto been examined by setting the contacts to a predetermined gap length manually.

In slow closing methods in these conventional gas-insulated cubicles, the gap length of the contacts has been set to a predetermined value by moving a plunger of an electromagnetic apparatus for closing the contacts of the vacuum interrupter using a manually-operated handle and interposing a spacer between an opening and closing lever and a damper operating interdependently with the movement of the plunger. (See Patent Literature 1, for example.)

In these conventional slow closing methods, because the spacer is slid between the opening and closing lever and the damper by pressing a push button mounted to the spacer, the spacer can be interposed between the opening and closing lever and the damper by an external push-button operation, making the operation of mounting the spacer safer. Because a resetting spring is interposed between the push button and a guiding frame for the push button, the spacer is withdrawn from between the opening and closing lever and the damper automatically after a withstand voltage test by ceasing to press the push button, making the operation of removing the spacer safer. In addition, because a pin is disposed so as to protrude from the opening and closing lever and a securing portion is formed on the spacer such that the pin is engaged in the securing portion when the spacer is interposed between the opening and closing lever and the damper, it is possible to leave the push button pressed, enabling the withstand voltage test to be executed more safely.

Patent Literature 1: Japanese Patent Laid-Open No. HEI 11-86696 (Gazette)

Conventional vacuum circuit breaker slow closing methods have the following problems:

(1) Because the gap length is set by interposing the spacer between the opening and closing lever and the damper, fine adjustment of the gap length is not possible;

(2) Because the contacts are moved by a lever principle using a manually-operated handle, workability is reduced when setting the gap length;

(3) Specialized equipment is required when performing slow closing, increasing costs; and (4) The construction of an operating mechanism portion is complicated, making workability poor in slow closing methods in which the operating mechanism portion is operated.

SUMMARY OF THE INVENTION

The present invention aims to solve the above problems and an object of the present invention is to provide a vacuum circuit breaker disposed so as to be fixed inside a switchgear, a vacuum circuit breaker contact slow closing method, and a contact erosion measuring method and contact gap length setting method using that slow closing method enabling vacuum circuit breaker contact erosion to be measured accurately without using specialized equipment.

In order to achieve the above object, according to one aspect of the present invention, there is provided a vacuum circuit breaker contact slow closing method for a vacuum breaker circuit including: a vacuum interrupter; a shaft disposed such that a central axis thereof is perpendicular to a closing and opening direction of a contact of the vacuum interrupter; a lever fixed to the shaft so as to be perpendicular to the shaft; an electrically-insulating rod coupled to a first end of the lever, the electrically-insulating rod moving in the closing and opening direction of the contact interdependently with rotation of the shaft to close and open the contact of the vacuum interrupter; and an operating mechanism portion for closing and opening the contact of the vacuum interrupter by driving the shaft so as to rotate when a circuit making command or breaking command is received, wherein the contact of the vacuum interrupter is moved from the open state to the closed state by: rotating an adjusting rod disposed rotatably; converting rotational motion of the adjusting rod into rectilinear motion by means of an internal thread member into which the adjusting rod is screwed; transmitting the converted rectilinear motion to a power-bearing member mounted to a second end of the lever to rotate the shaft; and moving the electrically-insulating rod in the closing and opening direction of the contact interdependently with the rotation of the shaft.

According to the present invention, rotational motion of the adjusting rod is converted to rectilinear motion by the internal thread member. Then, the vacuum interrupter contact moves from an open state to a closed state due to this converted rectilinear motion. Thus, because the movable contact can be moved simply by rotating the adjusting rod, the movable contact can be moved simply, slowly, and accurately without using specialized dedicated equipment, and the position of the movable contact can also be fixed simply by stopping the rotation of the adjusting rod. Consequently, because movement of the movable contact can be stopped at a contact closing point, the influence of squeezing originating from a compression spring can be removed, enabling contact erosion to be measured accurately. In addition, because a contact gap length can be set by rotating the adjusting rod in reverse to move the contact to the open state from the closing point, the influence of contact erosion conditions can be removed, enabling the contact gap length to be set accurately.

DETAILED DESCRIPTION OF THE PREFERRED EMBODIMENTS

Preferred embodiments of the present invention will now be explained with reference to the drawings.

Embodiment 1

Figure 1:
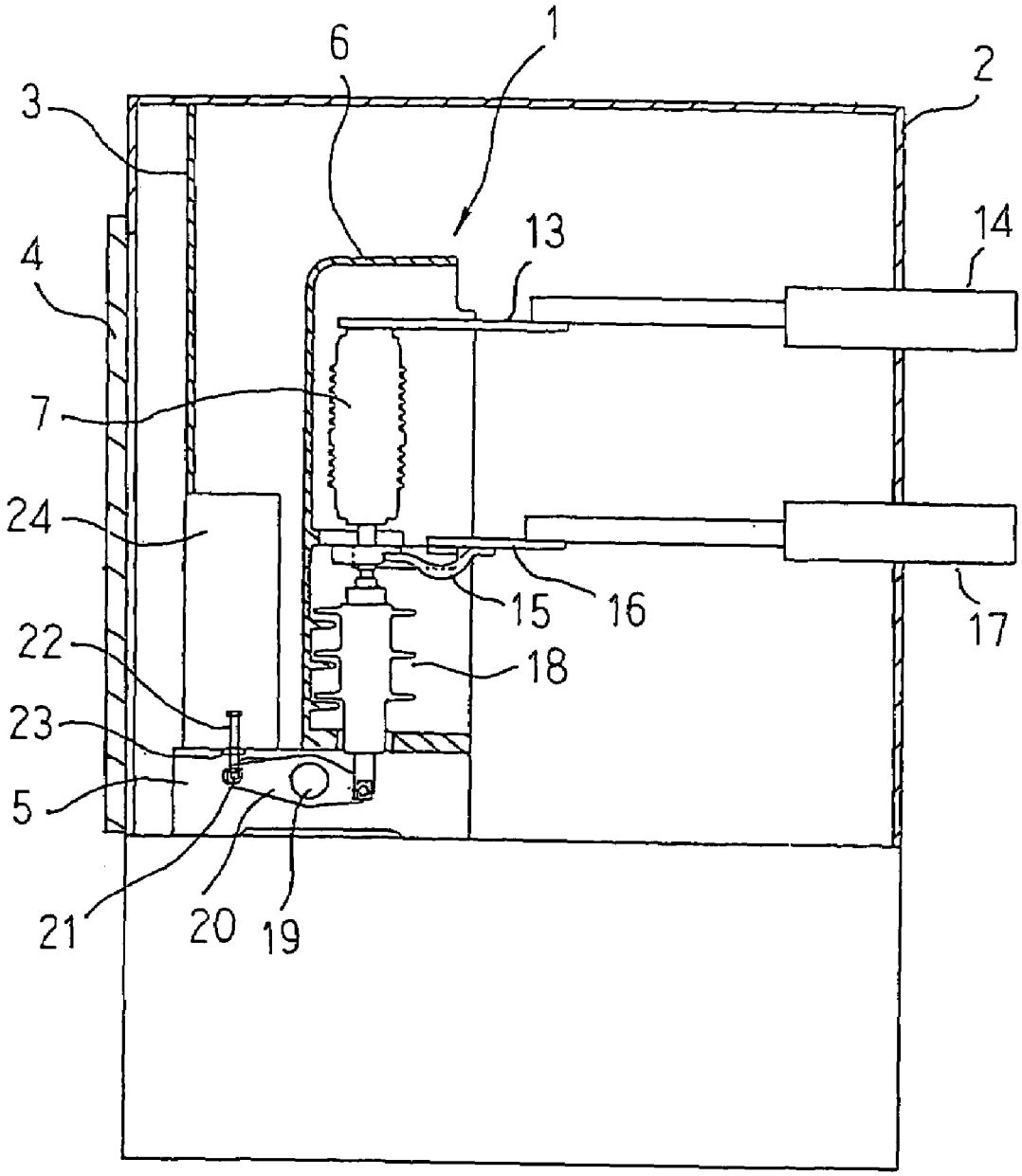
FIG. 1 is a partially cut-away side elevation showing a vacuum circuit breaker according to Embodiment 1 of the present invention.
Figure 2:
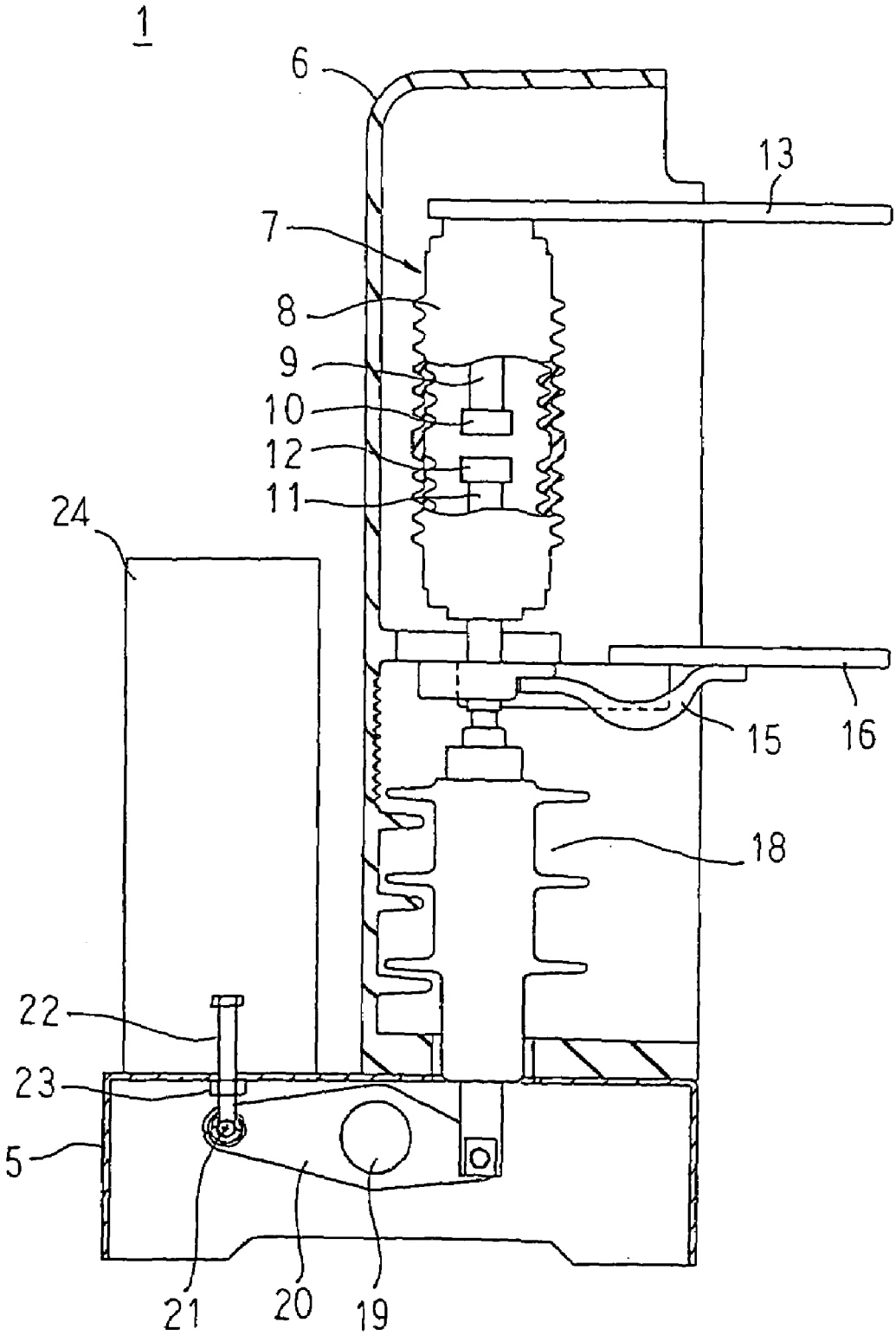
FIG. 2 is a partially cut-away side elevation showing part of the vacuum circuit breaker according to Embodiment 1 of the present invention.
Figure 3:
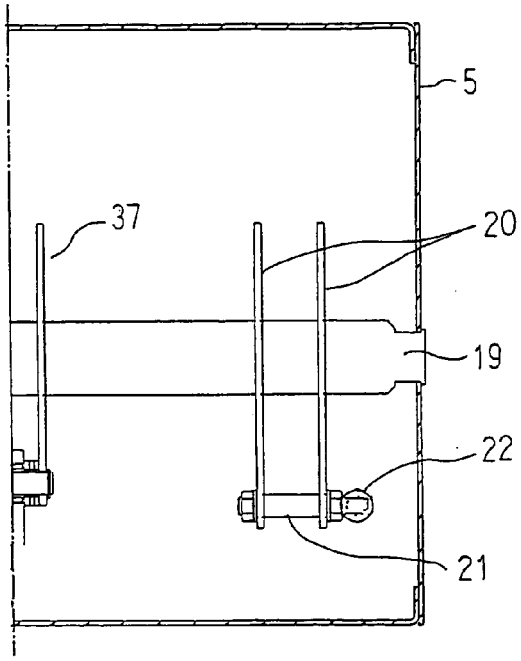
FIG. 3 is a partially cut-away top plan showing the vacuum circuit breaker according to Embodiment 1 of the present invention.
Figure 4:
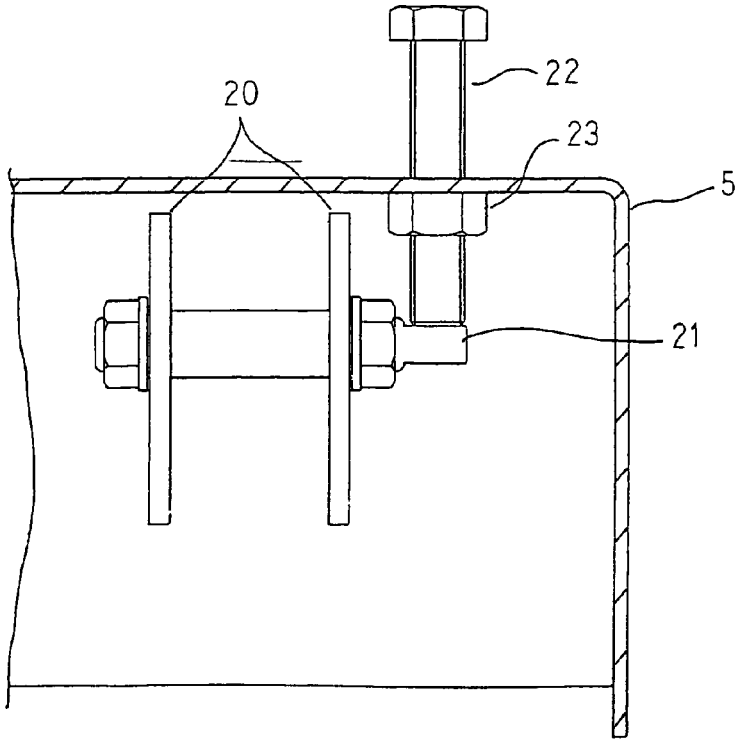
FIG. 4 is a cross section showing a vicinity of an adjusting bolt in the vacuum circuit breaker according to Embodiment 1 of the present invention.
Figure 5:
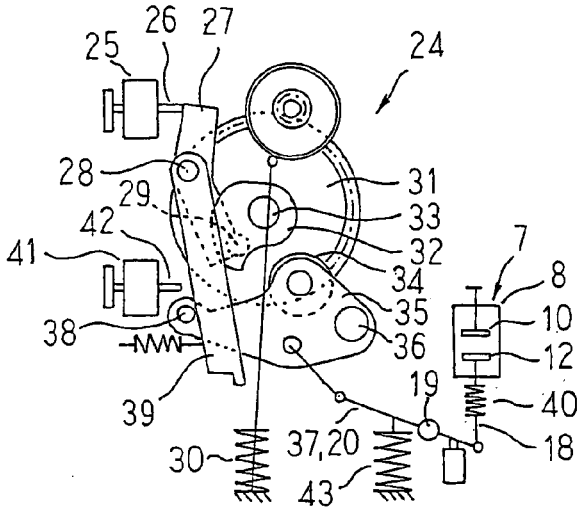
FIG. 5 is a diagram schematically explaining an action of an operating mechanism portion in the vacuum circuit breaker according to Embodiment 1 of the present invention.
Figure 6:
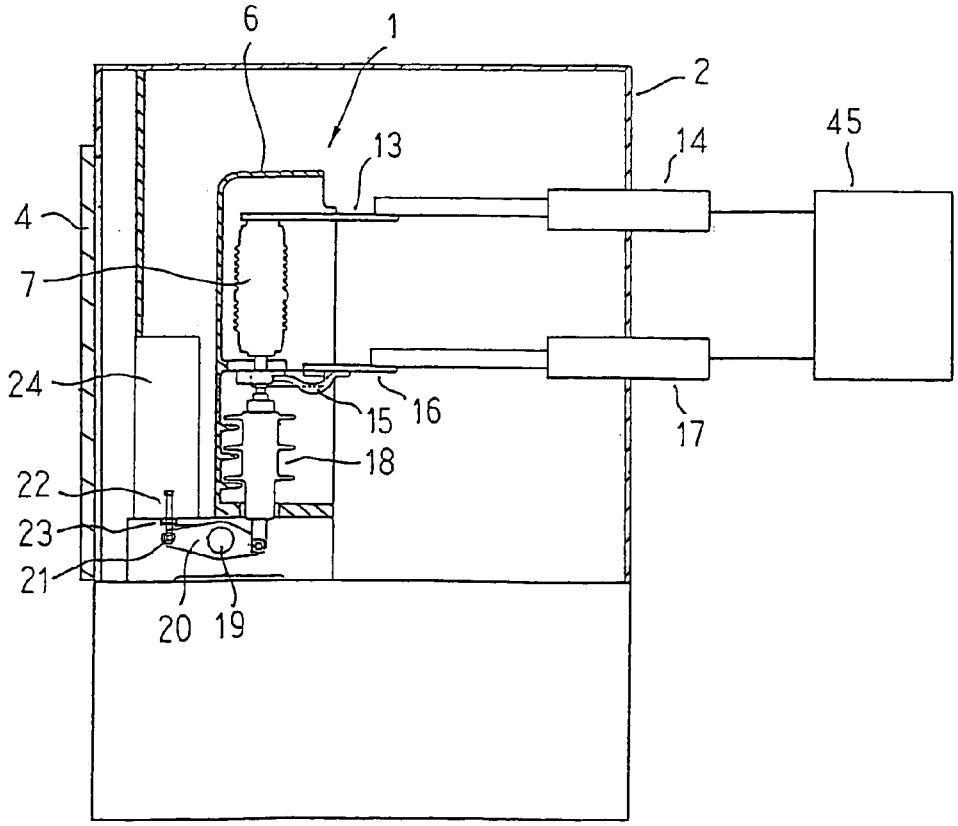
FIG. 6 is a diagram explaining a contact contacting position measuring method in the vacuum circuit breaker according to Embodiment 1 of the present invention.
Figure 7:
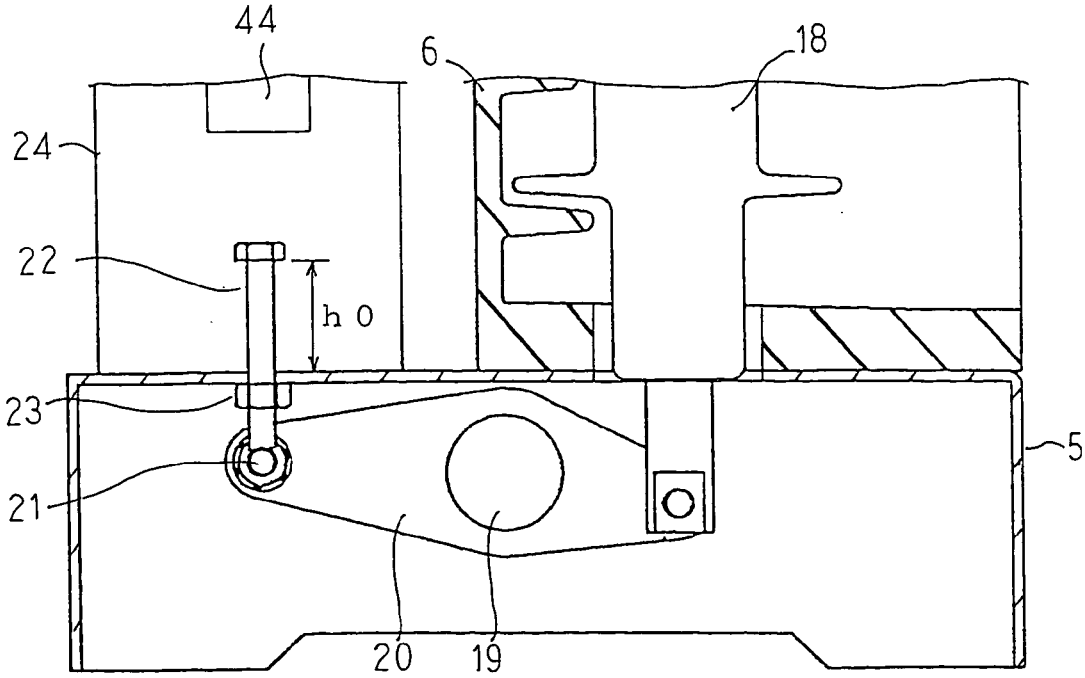
FIG. 7 is a partial cross section showing an open state of the contacts in the vacuum circuit breaker according to Embodiment 1 of the present invention.
Figure 8:
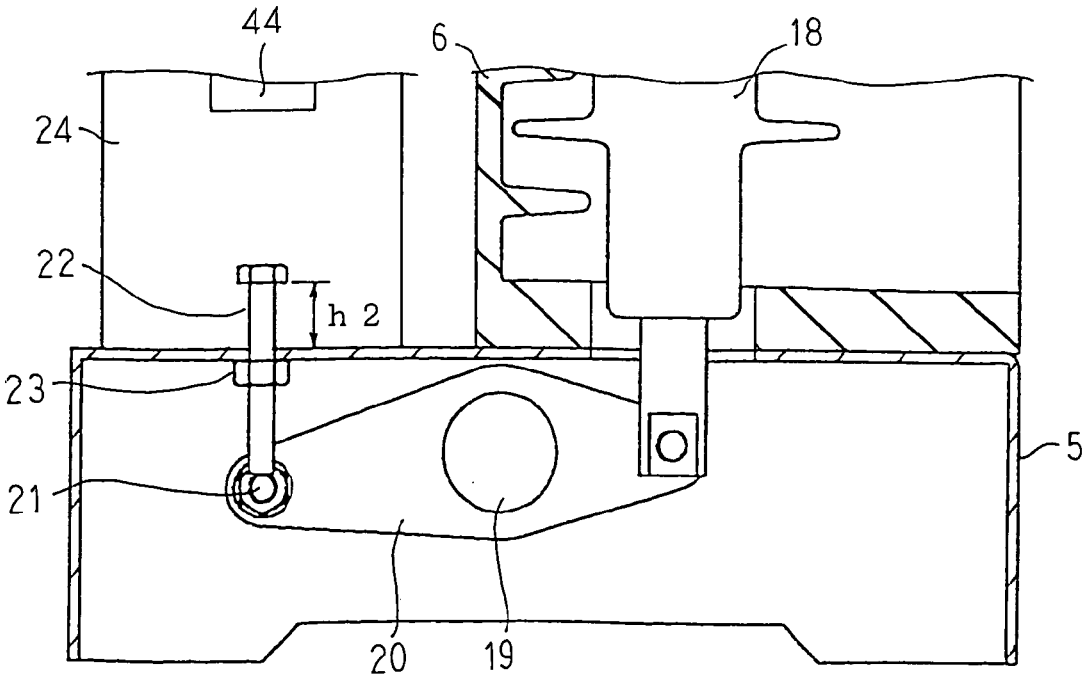
FIG. 8 is a partial cross section showing a closed state of the contacts in the vacuum circuit breaker according to Embodiment 1 of the present invention.

FIG. 1 is a partially cut-away side elevation showing a vacuum circuit breaker according to Embodiment 1 of the present invention, FIG. 2 is a partially cut-away side elevation showing part of the vacuum circuit breaker according to Embodiment 1 of the present invention, FIG. 3 is a partially cut-away top plan showing the vacuum circuit breaker according to Embodiment 1 of the present invention, FIG. 4 is a cross section showing a vicinity of an adjusting bolt in the vacuum circuit breaker according to Embodiment 1 of the present invention, FIG. 5 is a diagram schematically explaining an action of an operating mechanism portion in the vacuum circuit breaker according to Embodiment 1 of the present invention, FIG. 6 is a diagram explaining a contact contacting position measuring method in the vacuum circuit breaker according to Embodiment 1 of the present invention, FIG. 7 is a partial cross section showing an open state of the contacts in the vacuum circuit breaker according to Embodiment 1 of the present invention, and FIG. 8 is a partial cross section showing a closed state of the contacts in the vacuum circuit breaker according to Embodiment 1 of the present invention.

In FIGS. 1 through 4, a vacuum circuit breaker 1 is installed inside an airtight enclosure 2 in a fixed state. Current-bearing portions such as first and second conductors 13 and 16, a flexible conductor 15, first and second bushings 14 and 17, etc., described below, are separated from exterior portions by a partitioning plate 3 so as not to be contacted easily when a door 4 of the enclosure 2 is opened.

The vacuum circuit breaker 1 includes: a housing 6 fixed to a dolly 5; a vacuum interrupter 7 mounted to the housing 6; and an operating mechanism portion 24 for operating the vacuum interrupter 7, mounted to the dolly 5.

The vacuum interrupter 7 includes: a vacuum vessel 8 having an interior portion maintained at a vacuum of less than or equal to $10^{-2}$ Pa, for example, the vacuum vessel 8 being held on the housing 6 with a central axis aligned vertically; a fixed electrode rod 9 mounted coaxially and gastightly through an upper portion end plate of the vacuum vessel 8; a fixed contact 10 attached to a leading edge of the fixed electrode rod 9; a movable electrode rod 11 mounted coaxially and gastightly through a lower portion end plate of the vacuum vessel 8 so as to be movable axially; and a movable contact 12 attached to a leading edge of the movable electrode rod 11 so as to face the fixed contact 10. The fixed contact 10 is electrically connected through the fixed electrode rod 9 and a first conductor 13 to a first bushing 14 mounted to the airtight enclosure 2. The movable contact 12 is electrically connected through the movable electrode rod 11, a flexible conductor 15, and a second conductor 16 to a second bushing 17 mounted to the airtight enclosure 2. The movable electrode rod 11 is coupled to the operating mechanism portion 24 by means of an electrically-insulating rod 18 disposed coaxially on a lower portion of the vacuum vessel 8.

Moreover, an example in which the central axis of the vacuum vessel 8 is oriented vertically is described here, but the orientation of the central axis of the vacuum vessel 8 is not limited to a vertical direction and may be in any direction.

A shaft 19 is supported inside the dolly 5 so as to be perpendicular to the central axis of the electrically-insulating rod 18. A pair of levers 20 are attached to the shaft 19 so as to have a predetermined clearance from each other. First ends of the pair of levers 20 are coupled pivotably to a lower end of the electrically-insulating rod 18. A pin 21 functioning as a power-bearing member is mounted to second ends of the pair of levers 20 so as to be parallel to the shaft 19. An adjusting bolt 22 is screwed into a nut 23 functioning as an internal thread member attached to the dolly 5 at a position above the pin 21. A central axis of the adjusting bolt 22 is disposed so as to be parallel to the electrically-insulating rod 18, in other words parallel to a closing and opening direction of the contacts. Rotational motion of the adjusting bolt 22 is converted to rectilinear motion by the nut 23. Thus, the adjusting bolt 22 is designed to descend and be placed in contact with the pin 21 when turned relative to the nut 23.

Moreover, an example in which the central axis of the adjusting bolt 22 is disposed parallel to the closing and opening direction of the contacts is described here, but the direction of the central axis of the adjusting bolt 22 is determined by relative positioning between the position where the adjusting bolt 22 is mounted above the dolly 5 and the pin 21 and is not limited to being parallel to the closing and opening direction of the contacts, and any direction can be selected appropriately. However, as shown in FIG. 2, by disposing the central axis of the adjusting bolt 22 parallel to the closing and opening direction of the contacts, it is possible to perform visual checking and adjusting operations from in front of the vacuum circuit breaker more easily than if the central axis is aligned in any other direction.

Moreover, in addition to the vacuum circuit breaker 1, various kinds of high-voltage equipment such as potential transformers (PTs), current transformers (CTs), etc., may also be housed inside the gastight enclosure 2, but depiction thereof is omitted here. Furthermore, a single-phase vacuum circuit breaker is shown in each of the figures to facilitate explanation.

Next, closing and opening actions of the contacts of the vacuum interrupter 7 will be explained based on action of the operating mechanism portion 24 shown in FIG. 5.

First, when a circuit making command is issued, a making coil 25 is excited, pushing out a making rod 26. A making latch 27 is thereby pivoted clockwise around a shaft 28, dislodging engagement between the making latch 27 and a making latch roller 29. Thus, a making cam 32 configured integrally with a large gearwheel 31 is pivoted clockwise around a shaft 33 by force stored in a making spring 30. The making cam 32 presses an output roller 34 downward, pivoting an output lever 35 counterclockwise around a shaft 36. A lever 37 attached to the shaft 19 pivots counterclockwise around a central axis of the shaft 19 together with the shaft 19 due to the pivoting of the output lever 35. The levers 20 pivot counterclockwise around the central axis of the shaft 19 due to the pivoting of the shaft 19. Thus, the electrically-insulating rod 18 is pushed upward, placing the movable contact 12 in contact with the fixed contact 10 to close the contacts of the vacuum interrupter 7. Then, a pin 38 of the output lever 35 engages with a pawl 39, preventing the output lever 35 from pivoting clockwise. Thus, the vacuum interrupter 7 will not be interrupted.

When this making action is completed, an electric motor (not shown) is activated to store energy in the making spring 30 and return it to its initial state. Here, the movable contact 12 is pressed against the fixed contact 10 by a pressing spring 40 having a large acting force. Thus, a large contact pressure arises between the contacts of the vacuum interrupter 7, enabling a large current to pass through stably.

Next, when a circuit breaking command is issued, a tripping coil 41 is excited, pushing out a tripping rod 42. Thus, the pin 38 and the pawl 39 are disengaged, and the output lever 35 is pivoted clockwise around the shaft 36 by force stored in a return spring 43. The lever 37 attached to the shaft 19 pivots clockwise around the central axis of the shaft 19 together with the shaft 19 due to the pivoting of the output lever 35. The levers 20 pivot clockwise around the central axis of the shaft 19 due to the pivoting of the shaft 19. Thus, the electrically-insulating rod 18 is pulled downward, separating the movable contact 12 from the fixed contact 10 to open the contacts of the vacuum interrupter 7. The electrically-insulating rod 18, the shaft 19, the output lever 35, etc, return to their initial states.

Now, erosion occurs on the contacting portions between the fixed contact 10 and the movable contact 12 due to the closing and opening of the contacts of the vacuum interrupter 7. This erosion acts so as to reduce contact pressure between the fixed contact 10 and the movable contact 12 and in the worst cases large currents cannot pass through stably. Thus, it is necessary to measure the erosion of the fixed contact 10 and the movable contact 12 during maintenance.

In the vacuum circuit breaker 1, in order to enable large currents to pass through stably, a pressing spring 40 having a large acting force is used to generate a large contact pressure between the contacts of the vacuum interrupter 7. Due to the action of the contact pressure spring 40, a squeezing force continues to act on the fixed contact 10 through the movable contact 12 even after the movable contact 12 has come into contact with the fixed contact 10. Thus, the contacting position of the contacts cannot be measured accurately from the position of the electrically-insulating rod 18 if the contacts are closed by the operating mechanism portion 24 because the electrically-insulating rod 18 moves further in the direction of squeezing by a predetermined amount after the movable contact 12 has come into contact with the fixed contact 10. In other words, the contacting position of the contacts cannot be measured accurately from the pivoting angle of the shaft 19 if the contacts are closed using the operating mechanism portion 24 because the shaft 19 pivots further by a predetermined angle after the movable contact 12 has come into contact with the fixed contact 10.

From the above, it is necessary to consider the amount of movement of the electrically-insulating rod 18 and the shaft 19 after the contacts meet (the amount of squeezing of the contacts) in order to measure the erosion of the fixed contact 10 and the movable contact 12. In other words, in order to measure contact erosion, it is necessary to ascertain accurately the position that the movable contact 12 comes into contact with the fixed contact 10, making it is necessary to enable fine adjustment to the contacting position of the contacts by moving the movable contact 12 slowly to slow close the contacts.

Next, a contact erosion measuring method using a contact slow closing method according to Embodiment 1 will be explained with reference to FIGS. 6 through 8.

First, the contacts of the vacuum interrupter 7 are in an open state. Then, as shown in FIG. 6, a current sensor 45 functioning as a closing detecting apparatus is set between the first and second bushings 14 and 17. Next, as shown in FIG. 7, the adjusting bolt 22 is adjusted so as to be placed in contact with the pin 21. A height h0 of the adjusting bolt 22 is a distance from an upper surface of the dolly 5 to a lower surface of a head portion of the adjusting bolt 22, for example. Because the pin 21 is always returned to its initial position when the contacts are in the open state, the height h0 of the adjusting bolt 22 is always constant.

Next, the adjusting bolt 22 is turned by a worker to lower the adjusting bolt 22. By lowering the adjusting bolt 22, the pin 21 is pressed downward, pivoting the levers 20 counterclockwise around the shaft 19 in FIG. 7. Thus, the electrically-insulating rod 18 is pushed upward, moving the movable contact 12 toward the fixed contact 10. When the movable contact 12 comes into contact with the fixed contact 10, the circuit is closed and a contact signal flows through the current sensor 45. The worker recognizes this contact closing point from the contact signal of the current sensor 45 and stops turning the adjusting bolt 22. Then, a height h2 of the adjusting bolt 22 is measured. Here, (h0−h2) corresponds to the amount of movement of the adjusting bolt 22. Moreover, a height h1 of the adjusting bolt 22 at the closing point of the fixed contact 10 and the movable contact 12 in their initial state before they are eroded has been measured in advance.

Thus, erosion Δh can be found by calculating $\Delta h=(h0-h2)-(h0-h1)=(h1-h2)$.

The erosion Δh is measured in this manner, and if the erosion Δh exceeds a specified value, the fixed contact 10 and the movable contact 12 should be replaced.

Here, the height of the adjusting bolt 22 is measured using a displacement measuring device 44. The displacement measuring device 44 is installed above the adjusting bolt 22, for example, and emits light toward an upper surface of a head portion of the adjusting bolt 22, receives the light reflected therefrom, and measures the distance between the displacement measuring device 44 and the head portion of the adjusting bolt 22 using a time difference from emission to return of the light. Here, the difference between the measured value in the open state of the contacts and the measured value in the closed state of the contacts corresponds to the amount of movement of the adjusting bolt 22. Moreover, the displacement measuring device is not limited to this configuration, and may be any configuration capable of measuring the amount of movement of the adjusting bolt 22 such as a block gauge or a scale, etc.

Moreover, (h0–h2) and (h0–h1) correspond to the displacement of the pin 21 from the open state of the contacts to the point at which the closed state is reached. In other words, in Embodiment 1, the displacement of the pin 21 is measured as the amount of movement of the adjusting bolt 22.

After measuring contact erosion, the adjusting bolt 22 is rotated in a reverse direction to move the contacts to the open state. In other words, the adjusting bolt 22 is raised by rotating it in the reverse direction. Then, the levers 20 are pivoted clockwise in FIG. 8 by the force stored in the return spring 43, and the shaft 19 pivots clockwise. Thus, the electrically-insulating rod 18 descends, and the movable contact 12 is separated from the fixed contact 10 and returns to the open state in FIG. 7. Here, circuit making and breaking actions are executed by the operating mechanism portion 24 without interference from the adjusting bolt 22.

In this manner, according to Embodiment 1, the levers 20 are attached to the shaft 19, the first ends of the levers 20 are coupled pivotably to the lower end of the electrically-insulating rod 18, and the pin 21 is mounted to the second ends of the levers 20 so as to be parallel to the shaft 19. The adjusting bolt 22 is screwed into the nut 23 attached to the dolly 5 at a position above the pin 21 such that its central axis is parallel to the closing and opening direction of the contacts. Thus, because the adjusting bolt 22 is lowered by turning it relative to the nut 23 to press the pin 21 downward and pivot the shaft 19, thereby moving the electrically-insulating rod 18 in a direction that closes the contacts, the contacts can be closed slowly, enabling fine adjustment of the contacting position of the contacts.

In addition, because the contact closing point is determined based on a detection signal from the current sensor 45 connected to the first and second bushings 14 and 17, the movable contact 12 can be fixed in the closed position at the contact closing point by ceasing to turn the adjusting bolt 22. Thus, the influence of the squeezing of the contacts by the contact pressure spring 40 is removed, enabling contact erosion to be measured accurately.

Because the amount of movement of the electrically-insulating rod 18 is adjusted by the amount of rotation of the adjusting bolt 22 relative to the nut 23, the position of the electrically-insulating rod 18 can be held by ceasing rotation of the adjusting bolt 22. Thus, it is not necessary to dispose a new mechanism for fixing the position of the electrically-insulating rod 18, enabling contact erosion to be measured simply using an inexpensive configuration.

Because the slow closing of the contacts is performed by the adjusting bolt 22 and the nut 23 mounted to the dolly 5, contact erosion can be measured without using the operating mechanism portion 24 and without pulling the vacuum circuit breaker 1 out of the gastight enclosure 2.

Moreover, in Embodiment 1 above, a pin 21 functioning as a power-bearing member is mounted to the second ends of the levers 20, but the pin 21 may also be eliminated by forming receiving portions for the adjusting bolt 22 integrally on the second ends of the levers 20.

Furthermore, an example in which an adjusting bolt 22 is used as an adjusting means has been explained, but any configuration in which an external thread is formed on an outer peripheral portion of a rod-shaped pressing bar and can be screwed together with an internal thread member is acceptable, and any such member, including the adjusting bolt 22, shall be called an adjusting rod.

Embodiment 2

Figure 9:
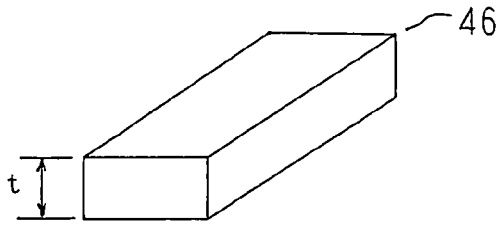
FIG. 9 is a perspective showing a determining gauge used in a contact erosion measuring method in a vacuum circuit breaker according to Embodiment 2 of the present invention.
Figure 10A:
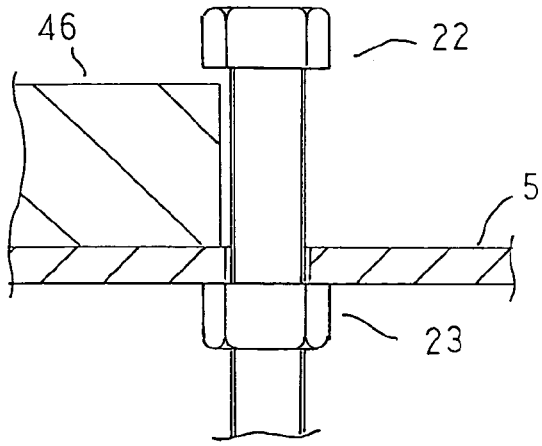
FIGS. 10A and 10B are partial cross sections showing the contact erosion measuring method in the vacuum circuit breaker according to Embodiment 2 of the present invention.
Figure 10B:
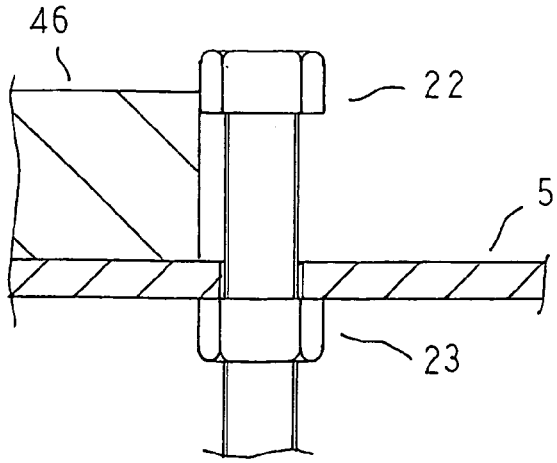

FIG. 9 is a perspective showing a determining gauge used in a contact erosion measuring method in a vacuum circuit breaker according to Embodiment 2 of the present invention, and FIGS. 10A and 10B are partial cross sections showing the contact erosion measuring method in the vacuum circuit breaker according to Embodiment 2 of the present invention, FIG. 10A showing a case in which the contact erosion is less than or equal to a specified value, and FIG. 10B showing a case in which the contact erosion exceeds the specified value.

In Embodiment 2, measurement of contact erosion is performed using a determining gauge 46 made into a rectangular parallelepiped having a predetermined thickness t, as shown in FIG. 9. Here, the thickness t of the determining gauge 46 is set so as to correspond to an amount of movement of an adjusting bolt 22 required to move contacts from an open state to a closed state when contact erosion has reached a tolerance limit value, for example.

Next, a contact erosion measuring method according to Embodiment 2 will be explained.

First, a current sensor 45 is set between first and second bushings 14 and 17, in a similar manner to Embodiment 1 above, and the adjusting bolt 22 is adjusted so as to be placed in contact with a pin 21. Next, the adjusting bolt 22 is turned by a worker to lower the adjusting bolt 22 and press the pin 21 downward. The shaft 19 is thereby pivoted, pushing an electrically-insulating rod 18 upward and moving a movable contact 12 toward a fixed contact 10. When the movable contact 12 comes into contact with the fixed contact 10, a circuit is closed and a contact signal flows through the current sensor 45. The worker recognizes the contact closing point from the contact signal of the current sensor 45 and stops turning the adjusting bolt 22.

Next, the contact erosion is measured by inserting the determining gauge 46 between a head portion of the adjusting bolt 22 and a dolly 5. Thus, if the determining gauge 46 can be inserted between the head portion of the adjusting bolt 22 and the dolly 5, as shown in FIG. 10A, it can be determined that the contact erosion has not yet reached the tolerance limit value. If the determining gauge 46 cannot be inserted between the head portion of the adjusting bolt 22 and the dolly 5, as shown in FIG. 10B, it can be determined that the contact erosion has exceeded the tolerance limit value. The fixed contact 10 and the movable contact 12 should then be replaced.

In Embodiment 2, because the slow closing of the contacts is also performed by an adjusting bolt 22 and a nut 23 mounted to a dolly 5, similar effects to those in Embodiment 1 above can also be achieved.

Because the inability or ability of a determining gauge 46 to be inserted between a head portion of the adjusting bolt 22 and an upper surface of the dolly 5 is used to determine whether or not contact erosion has exceeded a tolerance limit value, determination of contact erosion can be performed simply, without having to measure spacing between the head portion of the adjusting bolt 22 and the upper surface of the dolly 5, thereby improving maintainability.

Embodiment 3

Figure 11:
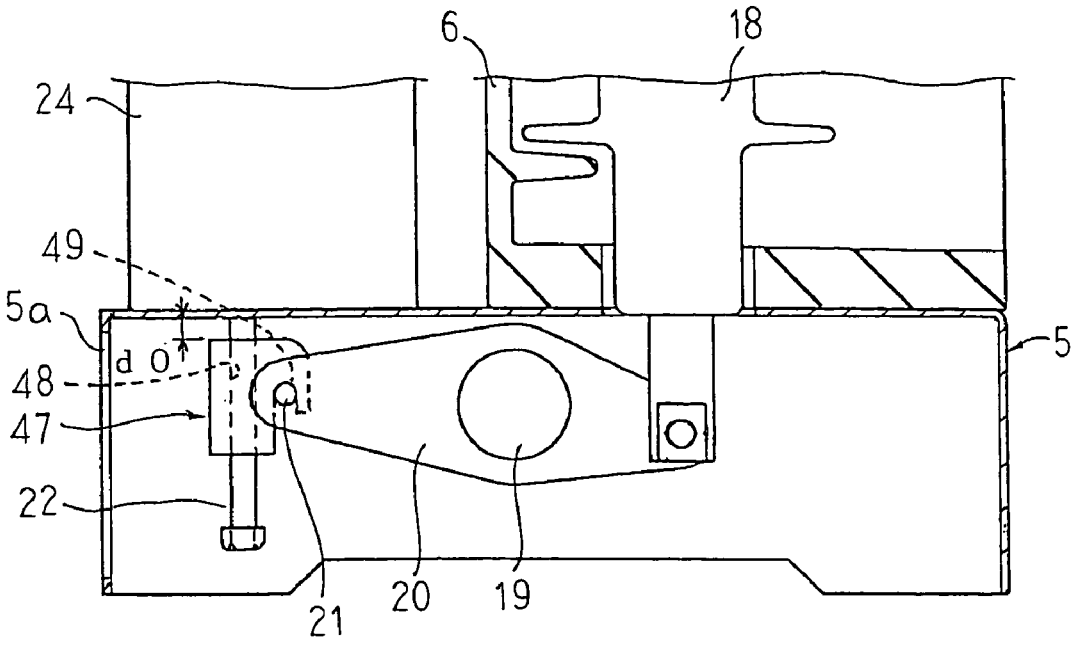
FIG. 11 is a partial cross section showing an open state of contacts in a vacuum circuit breaker according to Embodiment 3 of the present invention.
Figure 12:
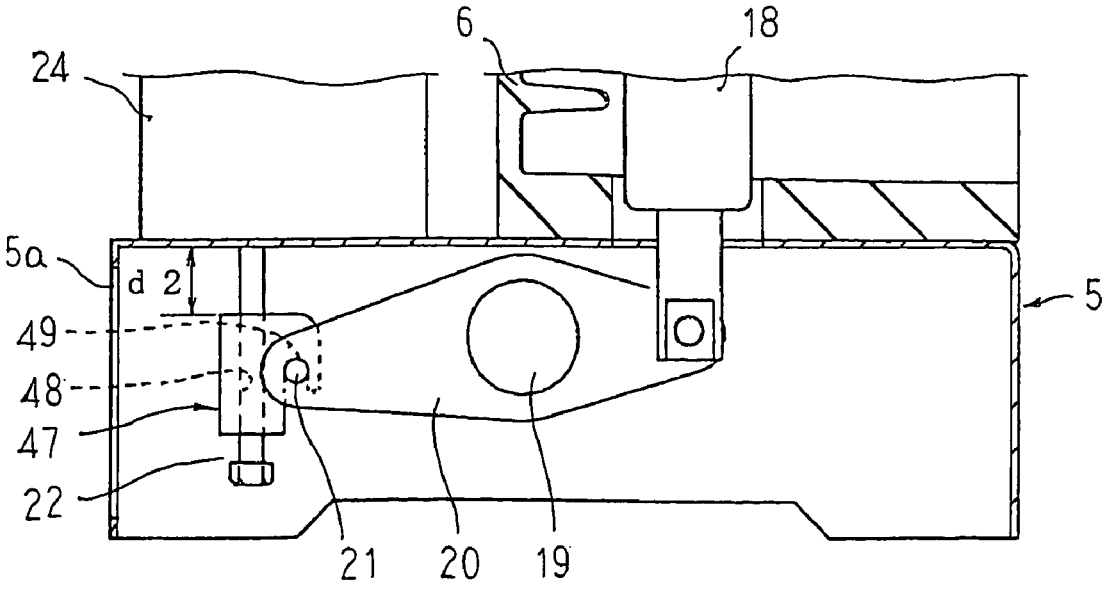
FIG. 12 is a partial cross section showing a closed state of the contacts in the vacuum circuit breaker according to Embodiment 3 of the present invention.

FIG. 11 is a partial cross section showing an open state of contacts in a vacuum circuit breaker according to Embodiment 3 of the present invention, and FIG. 12 is a partial cross section showing a closed state of the contacts in the vacuum circuit breaker according to Embodiment 3 of the present invention.

In FIGS. 11 and 12, a block 47 functioning as an internal thread member has: an internal thread portion 48 formed in a penetrating aperture; and a U-shaped hook portion 49 formed on an outer wall surface such that the hook is parallel to the penetrating aperture. The block 47 is hooked onto a pin 21 such that the hook portion 49 points downward, and an adjusting bolt 22 is screwed into the external screw thread portion 48 from below. Here, the block 47 mounted to the pin 21 is configured such that a central axis of the adjusting bolt 22 is parallel to a closing and opening direction of contacts.

Next, a contact erosion measuring method using a contact slow closing method according to Embodiment 3 will be explained.

First, a current sensor 45 is set between first and second bushings 14 and 17, in a similar manner to Embodiment 1, and the adjusting bolt 22 is adjusted such that a leading end placed in contact with a ceiling of a dolly 5 by turning the adjusting bolt 22 while restraining the block 47 through an opening 5*a* of the dolly 5. Because the pin 21 is always returned to its initial position when the contacts are in an open state, a clearance d0 between the block 47 and a ceiling of the dolly 5 is always constant. Here, because the block 47 is inserted between a pair of levers 20, the block 47 is prevented from rotating by the pair of levers 20 when the adjusting bolt 22 is turned. Rotational motion of the adjusting bolt 22 is thereby converted to rectilinear motion by the block 47. Because the adjusting bolt 22 is placed in contact with the ceiling of the dolly 5, the adjusting bolt 22 is prevented from rising, and the block 47 descends.

Next, the adjusting bolt 22 is turned by a worker to lower the block 47. By lowering the block 47, the pin 21 is pressed downward, pivoting the levers 20 counterclockwise around a shaft 19 in FIG. 11. Thus, the electrically-insulating rod 18 is pushed upward, as shown in FIG. 12, moving a movable contact 12 toward a fixed contact 10. When the movable contact 12 comes into contact with the fixed contact 10, a circuit is closed and a contact signal flows through the current sensor 45. The worker recognizes the closing of the contacts from the contact signal of the current sensor 45 and stops turning the adjusting bolt 22. Then, a clearance d2 between the block 47 and the ceiling of the dolly 5 is measured. Moreover, a clearance d1 between the block 47 and the ceiling of the dolly 5 at the closing point of the fixed contact 10 and the movable contact 12 in their initial state has been measured in advance.

Thus, erosion Δh can be found by calculating $\Delta h=(d2-d0)(d1-d0)=(d2-d1)$.

The erosion Δh is measured in this manner, and if the erosion Δh exceeds a specified value, the fixed contact 10 and the movable contact 12 should be replaced.

Moreover, (d2−d0) and (d1−d0) correspond to the displacement of the pin 21 from the open state of the contacts to the point at which the closed state is reached. In other words, in Embodiment 3, the displacement of the pin 21 is measured as the amount of movement of the block 47.

After measuring contact erosion, the adjusting bolt 22 is rotated in a reverse direction to move the contacts to the open state. In other words, the block 47 is raised by turning the adjusting bolt 22 in the reverse direction. Then, the levers 20 are pivoted clockwise in FIG. 12 by force stored in a return spring 43, and the shaft 19 pivots clockwise. Thus, the electrically-insulating rod 18 descends, and the movable contact 12 is separated from the fixed contact 10 and returns to the open state in FIG. 11. Here, circuit making and breaking actions are executed by the operating mechanism portion 24 without interference from the adjusting bolt 22.

Consequently, in Embodiment 3, because the slow closing of the contacts is performed by rotating an adjusting bolt 22 an adjusting bolt 22 screwed into an internal thread portion 48 of a block 47, similar effects to those in Embodiment 1 above can also be achieved.

Moreover, in Embodiment 3 above, the erosion of the fixed contact 10 and the movable contact 12 is explained as being measured by turning the adjusting bolt 22 and measuring the amount of descent of the block 47 at the contact closing point, but a determining gauge may also be used, in a similar manner to Embodiment 2 above, to determine that the erosion Δh has exceeded a tolerance limit value if the determining gauge can be inserted into the clearance between the block 47 and the ceiling of the dolly 5.

In Embodiment 3 above, the block 47 may also be mounted to the pin 21 by hooking the hook portion 49 onto the pin 21, a nut 23 fixed to the ceiling of the dolly 5, an adjusting bolt 22 passed through the ceiling from the upper surface of the dolly 5 and screwed into the nut 23, and the pin 21 lowered by means of the block 47 by turning the adjusting bolt 22 when measuring contact erosion, in a similar manner to Embodiment 1 above.

Embodiment 4

In Embodiment 1 above, measurement of the erosion of a fixed contact 10 and a movable contact 12 was explained, but In Embodiment 4, the present invention is applied to setting a contact gap length in a withstand voltage test of a vacuum interrupter 7.

In Embodiment 4, an electrically-insulating rod 18 is pushed upward by turning an adjusting bolt 22 to lower the adjusting bolt 22 and press a pin 21 downward, in a similar manner to Embodiment 1 above. Then, a worker confirms that a contact signal is flowing through a current sensor 45, and stops turning the adjusting bolt 22. A height h2 of the adjusting bolt 22 is then measured.

Next, the adjusting bolt 22 is turned in a reverse direction to raise the adjusting bolt 22. At this time, the pin 21 rises along with the ascent of the adjusting bolt 22 due to force stored in a return spring 43. The electrically-insulating rod 18 is thereby pressed downward, opening the contacts. A height h3 of the adjusting bolt 22 is then measured. Here, (h3−h2) corresponds to the contact gap length. Thus, the withstand voltage test is performed by adjusting the amount of rotation of the adjusting bolt 22 such that (h3−h2) has a predetermined value.

Now, in a conventional technique such as that described in Patent Literature 1, the contact gap length is set to the predetermined value by moving a plunger of an electromagnetic apparatus for closing the contacts of the vacuum interrupter using a manually-operated handle and interposing a spacer between a closing and opening lever and a damper operating interdependently with the movement of the plunger. However, in conventional techniques, no consideration has been given to contact erosion. Thus, if the contacts have been eroded, the contact gap length set by interposing the spacer may be much greater than the predetermined value.

In Embodiment 4, because the contact gap length is set based on the amount of movement of the adjusting bolt 22 from a height h2 of the adjusting bolt 22 at the contact closing point, the contact gap length set in this manner enables accurate withstand voltage testing to be performed without being affected by contact erosion.

Moreover, in each of the above embodiments, the closing and opening direction of the contacts of the vacuum interrupter 7 is vertical with a movable contact disposed so as to be positioned vertically below, but the closing and opening direction of contacts of a vacuum interrupter may also be vertical with a movable contact disposed so as to be positioned vertically above. In addition, the closing and opening direction of the contacts of the vacuum interrupter is not limited to being vertical and may be in any direction. For example, a vacuum interrupter may also be installed such that the closing and opening direction of the contacts is horizontal. Whatever the direction, a shaft is installed such that its central axis is perpendicular to the closing and opening direction of the contacts (a central axis of an electrically-insulating rod).

What is claimed is:

1. A vacuum circuit breaker comprising:

a vacuum interrupter;

a shaft disposed such that a central axis thereof is perpendicular to a closing and opening direction of a contact of said vacuum interrupter;

a lever fixed to said shaft so as to be perpendicular to said shaft;

an electrically-insulating rod coupled to a first end of said lever, said electrically-insulating rod moving in said closing and opening direction of said contact interdependently with rotation of said shaft to close and open said contact of said vacuum interrupter; and an operating mechanism portion for closing and opening said contact of said vacuum interrupter by driving said shaft so as to rotate when a circuit making command or breaking command is received, wherein:

said vacuum circuit breaker further comprises:

an adjusting rod disposed rotatably;

an internal thread member into which said adjusting rod is screwed, said internal thread member converting rotational motion of said adjusting rod into rectilinear motion; and a power-bearing member for transmitting said rectilinear motion converted by said internal thread member to said shaft to rotate said shaft;

whereby said shaft can be rotated to move said contact from an open state to a closed state by rotating said adjusting rod.

2. The vacuum circuit breaker according to claim 1, further comprising:

a closing detecting apparatus for detecting said closed state of said contact of said vacuum interrupter; and a displacement measuring device for measuring displacement of said power-bearing member from said open state of said contact up to a point at which said closed state is reached, whereby contact erosion can be measured based on an initial value of said displacement and said displacement measured by said displacement measuring device.

3. A vacuum circuit breaker contact slow closing method for a vacuum breaker circuit comprising:

a vacuum interrupter;

a shaft disposed such that a central axis thereof is perpendicular to a closing and opening direction of a contact of said vacuum interrupter;

a lever fixed to said shaft so as to be perpendicular to said shaft;

an electrically-insulating rod coupled to a first end of said lever, said electrically-insulating rod moving in said closing and opening direction of said contact interdependently with rotation of said shaft to close and open said contact of said vacuum interrupter; and an operating mechanism portion for closing and opening said contact of said vacuum interrupter by driving said shaft so as to rotate when a circuit making command or breaking command is received, wherein said contact of said vacuum interrupter is moved from said open state to said closed state by:

rotating an adjusting rod disposed rotatably;

converting rotational motion of said adjusting rod into rectilinear motion by means of an internal thread member into which said adjusting rod is screwed;

transmitting said converted rectilinear motion to a power-bearing member mounted to a second end of said lever to rotate said shaft; and moving said electrically-insulating rod in said closing and opening direction of said contact interdependently with said rotation of said shaft.

4. A vacuum circuit breaker contact erosion measuring method using the vacuum circuit breaker contact slow closing method according to claim 3, said erosion measuring method comprising:

a process in which a closing detecting means for detecting said closed state of said contact is set on said vacuum interrupter in said open state, said contact is moved from said open state to said closed state by rotating said adjusting rod, and rotation of said adjusting rod is ceased when said closing detecting means detects said closed state of said contact;

a process in which displacement of said power-bearing member from said open state of said contact up to a point at which said closed state is reached is measured; and a process in which contact erosion is calculated based on:

an initial displacement of said power-bearing member from said open state of said contact up to a point at which said closed state is reached in an uneroded state; and said measured displacement.

5. A vacuum circuit breaker contact erosion measuring method using the vacuum circuit breaker contact slow closing method according to claim 3, said erosion measuring method comprising:

a process in which a closing detecting means for detecting said closed state of said contact is set on said vacuum interrupter in said open state, said contact is moved from said open state to said closed state by rotating said adjusting rod, and rotation of said adjusting rod is ceased when said closing detecting means detects said closed state of said contact; and a process in which contact erosion is measured by comparing a size relationship between:

displacement of said power-bearing member from said open state of said contact up to a point at which said closed state is reached; and a determining gauge formed so as to have a predetermined thickness.

6. A vacuum circuit breaker contact gap length setting method using the vacuum circuit breaker contact slow closing method according to claim 3, said gap length setting method comprising:

a process in which a closing detecting means for detecting said closed state of said contact is set on said vacuum interrupter in said open state, said contact is moved from said open state to said closed state by rotating said adjusting rod, and rotation of said adjusting rod is ceased when said closing detecting means detects said closed state of said contact; and a process in which a contact gap length is set to a predetermined value by:

rotating said adjusting rod in reverse to move said contact from said closed state toward said open state; and stopping reverse rotation of said adjusting rod at a point when displacement of said power-bearing member from said closed state of said contact toward said open state reaches said predetermined value.

* * * * *